US006695519B2

(12) United States Patent
Tims et al.

(10) Patent No.: US 6,695,519 B2
(45) Date of Patent: Feb. 24, 2004

(54) DOUBLE PORTFOLIO

(75) Inventors: J. Michael Tims, Kettering, OH (US); Bobby G. James, Jr., Miamisburg, OH (US)

(73) Assignee: MeadWestvaco Corporation, Stamford, CT (US)

( * ) Notice: Subject to any disclaimer, the term of this patent is extended or adjusted under 35 U.S.C. 154(b) by 0 days.

(21) Appl. No.: 10/139,986

(22) Filed: May 7, 2002

(65) Prior Publication Data

US 2003/0210950 A1 Nov. 13, 2003

(51) Int. Cl.[7] ..... B42F 13/00

(52) U.S. Cl. ..... 402/73; 281/15.1; 281/21.1; 402/500; 402/502; D19/26

(58) Field of Search ..... 402/70, 73, 77, 402/500, 502; 281/15.1, 21.1, 31, 36, 37, 38; D19/26, 27

(56) References Cited

U.S. PATENT DOCUMENTS

| | | | | |
|---|---|---|---|---|
| 67,163 | A | | 7/1867 | Buzby |
| 102,189 | A | | 4/1870 | Williams |
| 212,762 | A | | 2/1879 | Stromberg |
| 231,394 | A | | 8/1880 | Brown |
| 303,346 | A | | 8/1884 | Vernon |
| 434,040 | A | | 8/1890 | Andrews |
| 499,906 | A | | 6/1893 | Carnahan |
| 665,256 | A | | 1/1901 | McComb |
| 815,502 | A | | 3/1906 | Anderson |
| 848,714 | A | | 4/1907 | Wise |
| 938,910 | A | | 11/1909 | Sultzer |
| 1,114,596 | A | | 10/1914 | Dustan |
| 1,405,134 | A | | 1/1922 | Hoyme |
| 1,460,426 | A | | 7/1923 | McSheehy |
| 1,495,953 | A | | 5/1924 | Dick |
| 1,526,044 | A | | 2/1925 | Blake |
| 1,698,828 | A | | 1/1929 | Smith |
| 1,717,801 | A | | 6/1929 | Metcalf |
| 1,733,388 | A | | 10/1929 | Piltzer |
| 1,861,459 | A | | 6/1932 | Smith |
| 1,912,710 | A | | 6/1933 | Kennedy |
| 2,136,186 | A | | 11/1938 | Frost |
| 2,225,264 | A | | 12/1940 | Farrior, Jr. |
| 2,318,192 | A | * | 5/1943 | Boelema ..... 281/31 |
| 2,596,131 | A | | 5/1952 | Darby et al. |
| 2,828,975 | A | | 4/1958 | Wright |
| 3,078,107 | A | | 2/1963 | Loderhose |
| 3,188,113 | A | | 6/1965 | Cross |
| 3,227,471 | A | | 1/1966 | Coniker |
| 3,537,728 | A | | 11/1970 | Reese |
| 3,565,462 | A | | 2/1971 | Gottlieb |
| 3,837,680 | A | | 9/1974 | Cimini |
| 3,870,223 | A | | 3/1975 | Wyant |
| 4,420,112 | A | | 12/1983 | Cline |
| 4,519,629 | A | | 5/1985 | Podosek |
| 4,620,725 | A | | 11/1986 | Maehashi |
| 4,682,310 | A | | 7/1987 | Lund et al. |
| 4,703,952 | A | | 11/1987 | Biasini |
| D312,277 | S | | 11/1990 | Moor |
| 5,236,226 | A | | 8/1993 | Sheffield |
| 5,284,242 | A | | 2/1994 | Roth et al. |
| 5,330,281 | A | | 7/1994 | Kalan |
| 5,411,293 | A | * | 5/1995 | Monzyk ..... 281/31 |
| 5,445,417 | A | | 8/1995 | Bromer et al. |
| 5,674,021 | A | * | 10/1997 | Hutnick ..... 402/14 |
| 5,676,482 | A | | 10/1997 | Hawkins |
| 5,725,252 | A | | 3/1998 | Crum et al. |
| 5,836,711 | A | | 11/1998 | Stewart |

(List continued on next page.)

*Primary Examiner*—Monica S. Carter
(74) *Attorney, Agent, or Firm*—Thompson Hine LLP

(57) ABSTRACT

A portfolio assembly including a first portfolio including a pair of opposed panels with a hinge line extending therebetween and a second portfolio including a pair of opposed panels with a hinge line extending therebetween. The first and second portfolios are directly coupled together at or adjacent to the hinge line of each portfolio.

48 Claims, 5 Drawing Sheets

U.S. PATENT DOCUMENTS

| | | | | | |
|---|---|---|---|---|---|
| 5,909,979 | A | | 6/1999 | Winzen | |
| 5,988,685 | A | | 11/1999 | Megelonsky et al. | |
| 5,997,207 | A | | 12/1999 | Robinson | |
| D425,557 | S | * | 5/2000 | Imbernino | D19/26 |
| 6,079,614 | A | | 6/2000 | Ho | |
| 6,210,065 | B1 | | 4/2001 | Tower | |
| 6,213,670 | B1 | | 4/2001 | Wien | |
| 6,241,414 | B1 | | 6/2001 | Wien | |
| 6,267,413 | B1 | | 7/2001 | Tran | |
| 6,276,722 | B1 | | 8/2001 | Moor | |
| D465,087 | S | * | 11/2002 | Shapiro | D3/303 |

* cited by examiner

DOUBLE PORTFOLIO

BACKGROUND OF THE INVENTION

Portfolios, folders, and other storage mechanisms are commonly used to store various loose leaf papers, such as papers torn from a notebook, notes, handouts or other loose items. However, the capacity of such portfolios is limited. Accordingly, there is a need for a portfolio which provides additional storage space for storing loose items.

SUMMARY OF THE INVENTION

The present invention is a double portfolio which can, in one embodiment, provide a plurality of pockets for storing loose items. In one embodiment, the portfolio includes two substantially identical portfolio components bound together at their spines. In one embodiment, the invention is a portfolio assembly including a first portfolio including a pair of opposed panels with a hinge line extending therebetween and a second portfolio including a pair of opposed panels with a hinge line extending therebetween. The first and second portfolios are directly coupled together at or adjacent to the hinge line of each portfolio.

Other objects and advantages will be apparent from the following description and the appended claims.

DETAILED DESCRIPTION

Figure 1:
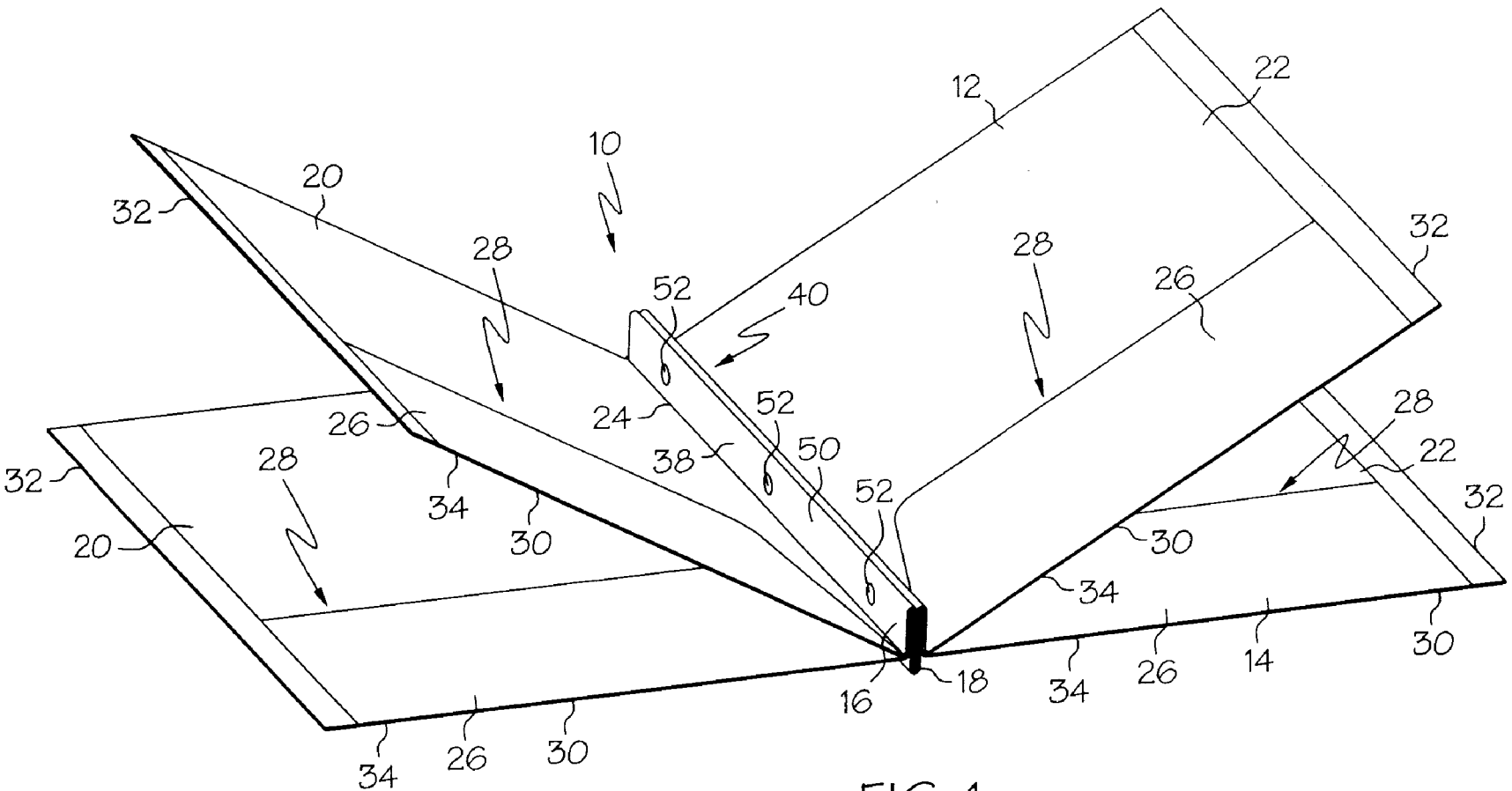
FIG. 1 is a front perspective view of one embodiment of the portfolio of the present invention.
Figure 2:
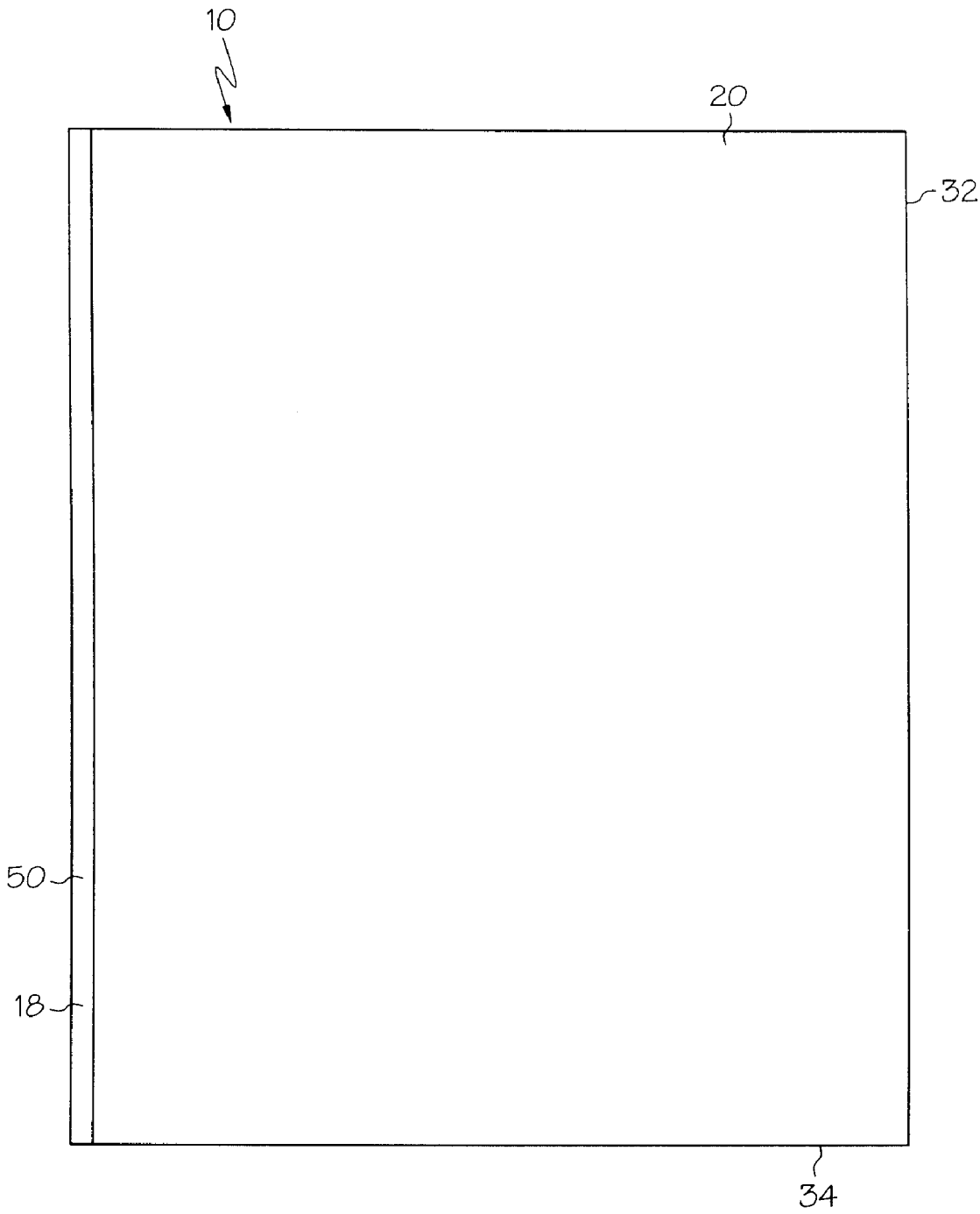
FIG. 2 is a front view of the portfolio of FIG. 1 in its closed position.

As best shown in FIG. 1, the present invention is a portfolio or portfolio assembly 10 including an inner 12 and an outer 14 portfolio or portfolio component bound together at their spines 16, 18. Although the shape and configuration of portfolio components 12, 14 may vary, in the illustrated embodiment both portfolio components 12, 14 include left 20 and right 22 opposed panels separated by a common hinge line 24. Each of the panels 20, 22 may be pivotable about the hinge line 24 such that each panel 20, 22 can face, be located adjacent to or facially abut against an adjacent panel (see, e.g., FIG. 2 which illustrates the portfolio 10 in its fully closed position).

As shown in FIG. 1, each panel 20, 22 may include a lower panel 26 located thereon such that each lower panel 26 and its associated panel 20, 22 form a pocket 28 therebetween. Each lower panel 26 may be coupled to its associated panel 20, 22 along the lower edge 30 and a portion of the side edge 32 of the associated panel 20, 22 to form the pocket 28. Each lower panel 26 may have about the same width of the associated panel 20, 22 and have a height of about one-third of the associated panel 20, 22, although the size and shape of the lower panels 26 can be varied as desired. As will be discussed in greater detail below, each of the portfolio components 12, 14 may be made from a single sheet or a single piece of material.

Figure 3:
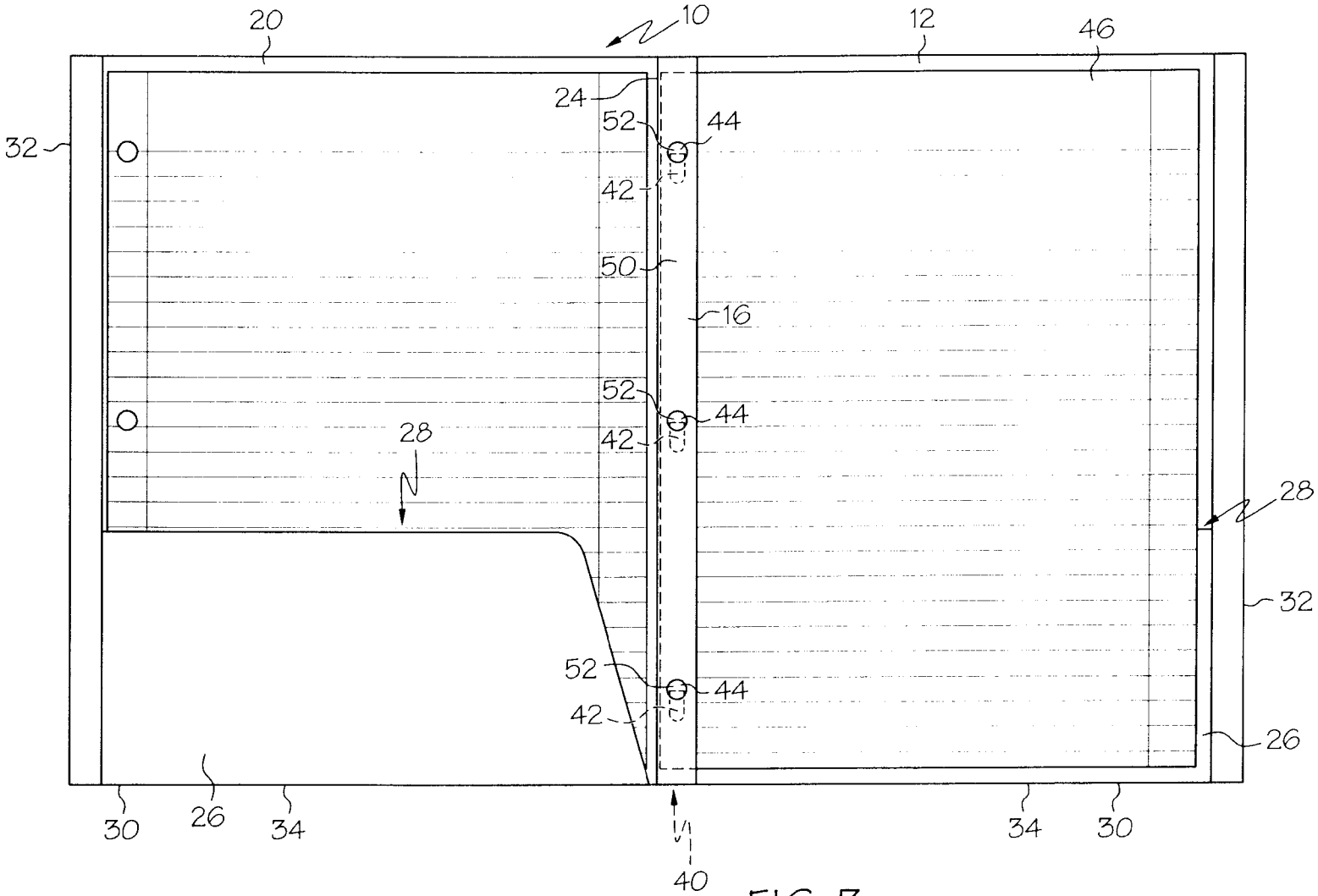
FIG. 3 is a front view of the portfolio of FIG. 1 in its open position and receiving a pair of sheets of paper therein.
Figure 4:
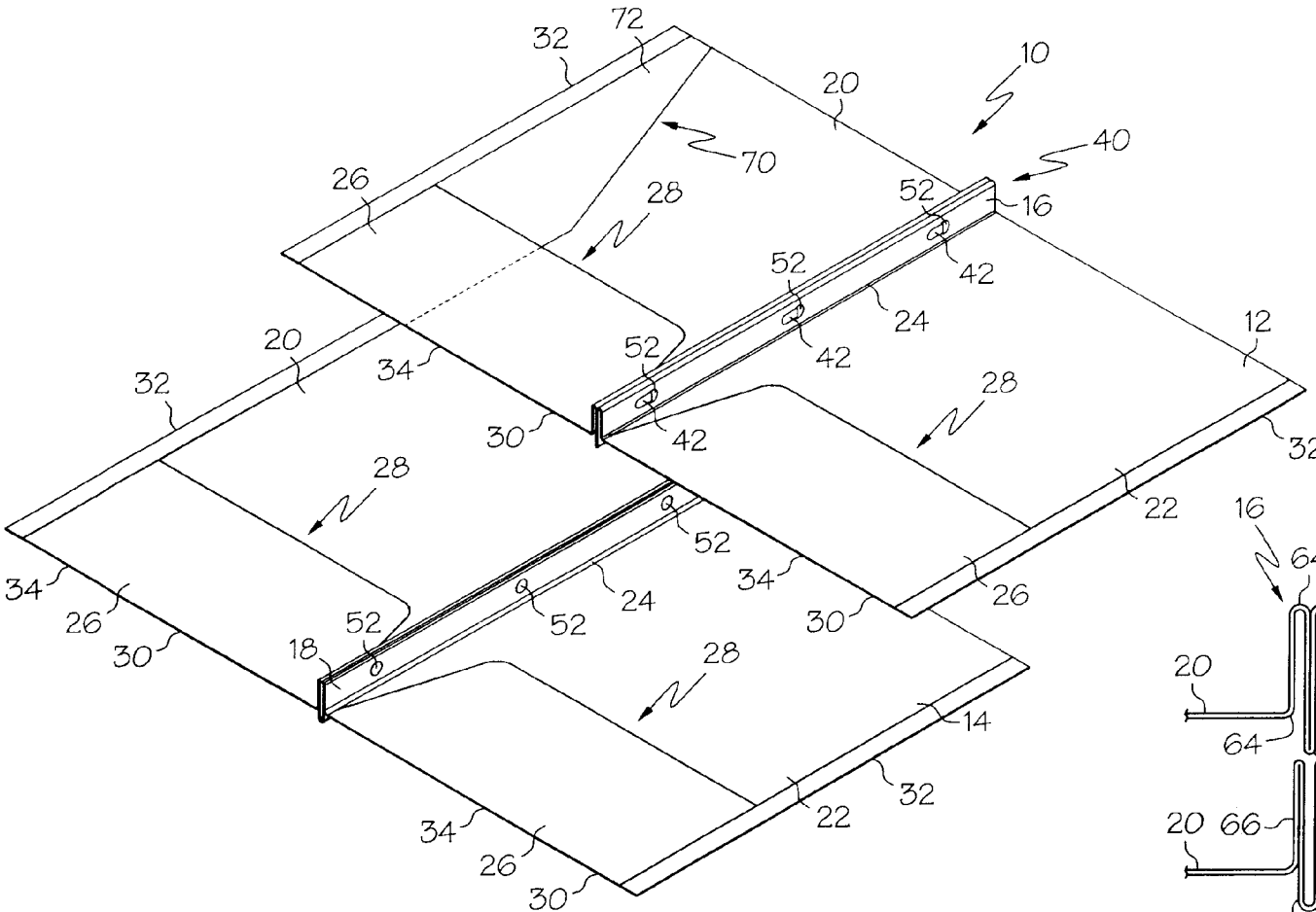
FIG. 4 is an exploded view of the portfolio of FIG. 1.

The portfolio 10 may include a spine portion 38 which may include or form part of the hinge line 24 of the portfolio 10, or extend outwardly from the hinge line 24. Because each panel 20, 22 may pivot about separate but closely spaced hinge lines, the term "hinge line" or "hinge portion" as used herein may include two or more hinge lines that are closely spaced. As best shown in FIG. 4, the inner portfolio component 12 may include a binding mechanism 40, such as a three-prong binding mechanism, located at or adjacent to the hinge line 24 or spine 38. In this manner, sheets of paper having a standard three-hole spacing can be coupled to the spine 38 of the portfolio by passing the prongs 42 through the holes 44 of a sheet 46 and deflecting the prongs 42 to retain a sheet 46 therein (FIG. 3).

Figure 5:
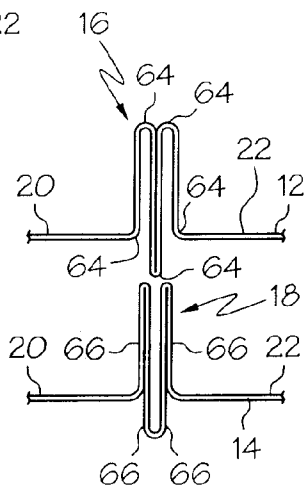
FIG. 5 is an end view of the spine of the exploded portfolio of FIG. 4.

As shown in FIGS. 4–5, the inner portfolio component 12 is nested inside of the outer portfolio component 14. As shown in FIG. 5, the spine 16 of the inner portfolio component 12 is nested inside the spine 18 of the outer portfolio component 14 to form the spine 50 of the portfolio 10. In this manner, the inner 12 and outer 14 portfolio components may be formed from identical blanks which reduces manufacturing costs and time.

Figure 6:
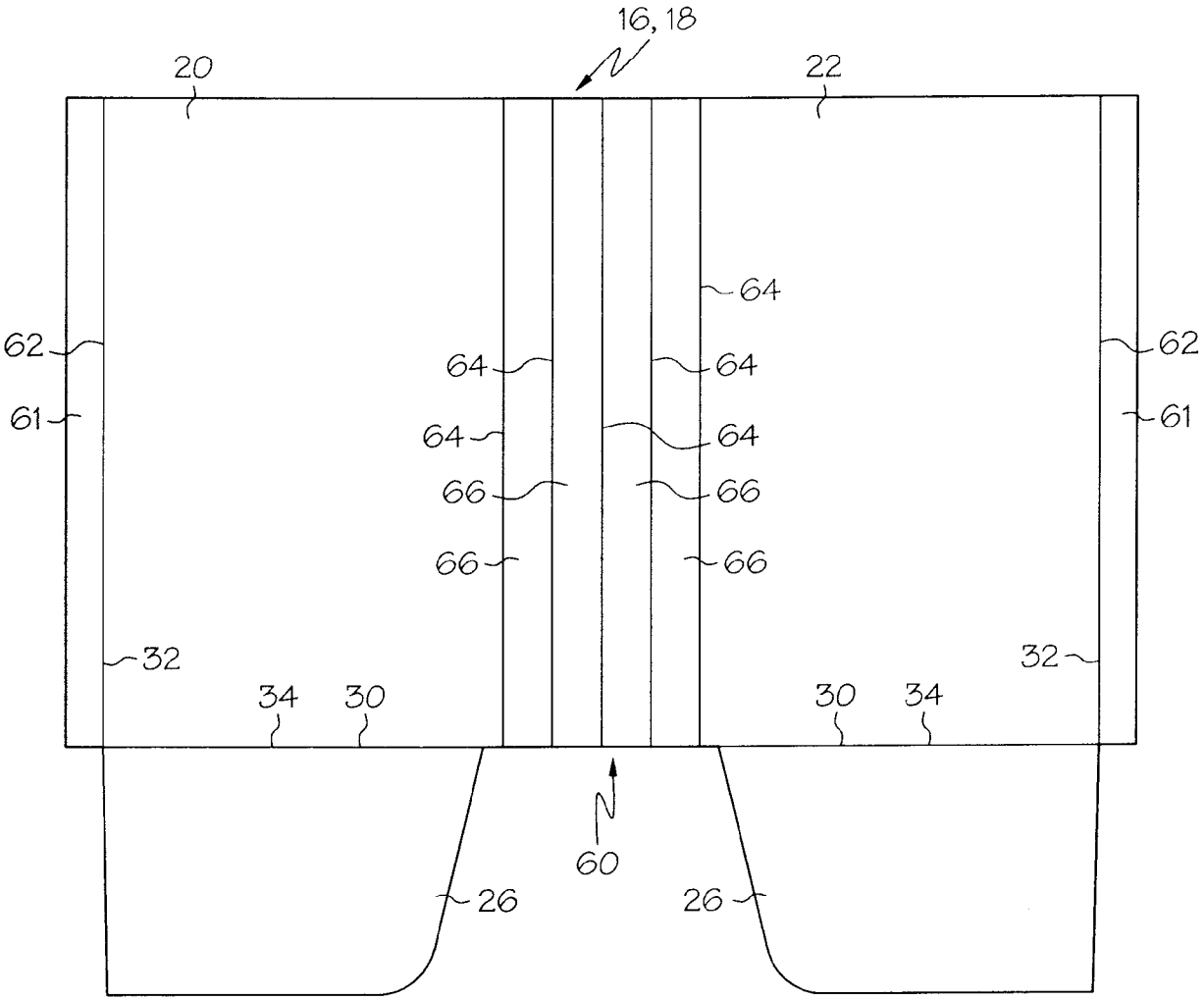
FIG. 6 is a top view of a blank that may be used to form a portfolio component.

In order to assemble the portfolio 10, the portfolio components 12, 14 may each be individually formed. As noted above, each of the portfolio component 12, 14 may be made from a single blank 60 or piece of material and folded and glued in order to form the desired portfolio components 12, 14. For example, FIG. 6 illustrated a blank 60 which includes the opposed panels 20, 22 and pair of lower panels 26 separated from the associated panel 20, 22 by fold lines 34. Each opposed panel 20, 22 may include a pair of side flaps 61 defined by a fold line 62. The blank 60 may also include a plurality of spine fold lines 64 and spine panels 66.

In order to form the blank 60 into a portfolio component 12, 14, the lower panels 26 are pivoted about the fold lines 34 until the lower panels 26 are located adjacent to, or facially abut against, the associated panel 20, 22. The side panels 61 are then folded inwardly about the fold lines 62 and glued or otherwise coupled to the panels 20, 22 and/or lower panels 26. The spine panels 66 and then folded about the associated spine fold lines 64 to form the spine 16, 18 of the portfolio component 12, 14 (see FIG. 5).

Once the portfolio components 12, 14 are formed, the inner 12 and outer 14 portfolio components may then be nested as shown in FIGS. 4 and 5. Next, the prong binding mechanism 40 may be mounted to the portfolios 12, 14, such as by punching a set of three holes 52 through the spine portion 50 and mounting a gusset, tab, or the like (not shown) and associated prong component 42 in each hole 52 such that the gussets couple the portfolio components 12, 14 together at their spines 16, 18.

The illustrated portfolio 10 provides four pockets 28 which provide ample space for storing various loose items. However, the portfolio 10 also may include more or less pockets than the four illustrated pockets, as desired, and need not necessarily include the prong binding mechanism 40. Furthermore, various other binding mechanisms, such as three-ring binding mechanisms, other prong coupling mechanisms, and the like may be used in place of the prong binding mechanism 40 without departing from the scope of the invention. If desired, the portfolio components 12, 14 may include pockets on their outer surfaces. In one embodiment, only the inner portfolio component 12 may include additional pockets on its outer surfaces. Of course, additional portfolio components beyond the two portfolio components illustrated herein may be nested and coupled to together to form a large portfolio assembly.

In the embodiment shown in FIG. 4, the portfolio 10 includes a generally vertically-opening pocket 70 located between a pocket flap 72 and the associated panel 20. In the illustrated embodiment, the pocket flap 72 is coupled to the panel 20 along the side edge 32 and the lower edge 30 of the panel 20, and the pocket flap 72 is located below the associated lower panel 26. However, it should be understood that the stacking arrangement of the pocket flap 72 and lower panel 26 may be reversed, and that each of the panels 20, 22 of each of the portfolio components 12, 14 may include only the vertically-opening pocket 70, only the pocket 28, or any combination of these or other types of pockets.

Having described the invention in detail and by reference to the preferred embodiments, it will be apparent that modifications and variations thereof are possible without departing from the scope of the invention.

What is claimed is:

1. A portfolio assembly comprising:

a first portfolio including a pair of opposed panels with a hinge line extending therebetween;

a second portfolio including a pair of opposed panels with a hinge line extending therebetween, wherein said first and second portfolios are directly coupled together at or adjacent to the hinge line of each portfolio, wherein at least one of said panels of at least one of said portfolios is movable relative to the other panel of said at least one portfolio by pivoting said at least one panel about an associated hinge line; and a spine portion extending generally parallel to said panels when said portfolio assembly is in a closed position wherein said panels of each portfolio are facing each other and are generally parallel.

2. The portfolio assembly of claim 1 wherein each panel of each portfolio is independently pivotable about the associated hinge line.

3. The portfolio assembly of claim 1 wherein said first portfolio is nested inside of said second portfolio.

4. The portfolio assembly of claim 3 wherein said first portfolio includes a binding mechanism located on or adjacent to the hinge line of said first portfolio.

5. The portfolio assembly of claim 4 wherein said binding mechanism is a prong binding mechanism.

6. The portfolio assembly of claim 1 wherein at least one panel of at least one of said portfolios includes a pocket located on an inner surface thereof.

7. The portfolio assembly of claim 1 wherein each panel of each of said portfolios includes a pocket located on an inner surface thereof.

8. The portfolio assembly of claim 1 wherein said first and second portfolios have substantially identical outer dimensions.

9. The portfolio assembly of claim 1 wherein each portfolio is made from a single, unitary sheet of material.

10. The portfolio assembly of claim 1 wherein each panel of each portfolio is directly coupled to the associated other panel of that portfolio.

11. The portfolio assembly of claim 1 wherein both of said panels of said at least one of said portfolios are movable relative to each other by pivoting either of said panels about the associated hinge line.

12. The portfolio assembly of claim 1 wherein both of said panels of both said portfolios are movable relative to the other panel of an associated portfolio by pivoting either of said panels about the associated hinge line.

13. The portfolio assembly of claim 1 wherein each panel of each portfolio is a generally flat, planar sheet-like material joined to the other panel of the associated portfolio at or immediately adjacent to the associated said hinge line to form a portfolio that is generally "V" shaped in end view when in a closed or substantially closed position.

14. The portfolio assembly of claim 1 wherein said spine portion is generally flat and planar, and extends generally inwardly away from one of said hinge lines.

15. The portfolio assembly of claim 1 further including a binding mechanism located on said spine portion.

16. The portfolio assembly of claim 15 wherein said binding mechanism is located between a pair of panels of one of said portfolios.

17. The portfolio assembly of claim 1 wherein said first portfolio is formed from a single unitary piece of sheet-like material, and wherein said second portfolio is formed from a single unitary piece of sheet-like material, and wherein one of said portfolios is nested inside the other one of said portfolios.

18. The portfolio assembly of claim 1 wherein each panel is a generally flat, sheet-like piece of material having two opposed major flat free surfaces defining the majority of the surface area of the associated panel.

19. A portfolio assembly comprising:

a first portfolio including a pair of opposed panels with a hinge line extending therebetween; and a second portfolio including a pair of opposed panels with a hinge line extending therebetween, wherein said first and second portfolios are directly coupled together at or adjacent to the hinge line of each portfolio, wherein at least one of said panels of at least one of said portfolios is movable relative to the other panel of said at least one portfolio by pivoting said at least one panel about an associated hinge line wherein each of said first and second portfolios includes a spine portion extending generally outwardly from the hinge line.

20. The portfolio assembly of claim 19 wherein said spine portion of said first portfolio is nested inside said spine portion of said second portfolio.

21. A portfolio assembly comprising:

a first portfolio including a pair of opposed panels with a hinge line extending therebetween, each panel of said first portfolio including a pocket located thereon;

a second portfolio including a pair of opposed panels with a hinge line extending therebetween, each panel of said second portfolio including a pocket located thereon, wherein said first and second portfolios are directly coupled together; and a spine portion extending generally parallel to said panels when said portfolio assembly is in a closed position wherein said panels of each portfolio are facing each other and are generally parallel.

22. The portfolio of claim 21 wherein said first and second portfolios are coupled together at or adjacent to said hinge lines.

23. The portfolio assembly of claim 21 when at least one of said panels of at least one of said portfolios is movable relative to the other panel of said at least one portfolio by pivoting said at least one panel about the associated hinge line.

24. The portfolio assembly of claim 23 wherein both of said panels of said at least one of said portfolios are movable relative to each other by pivoting either of said panels about the associated hinge line.

25. The portfolio assembly of claim 21 wherein both of said panels of both said portfolios are movable relative to the other panel of the associated portfolio by pivoting either of said panels about the associated hinge line.

26. The portfolio assembly of claim 21 wherein each panel of each portfolio is a generally flat, planar sheet-like material joined to the other panel of the associated portfolio at or immediately adjacent to the associated hinge line to form a portfolio that is generally "V" shaped in end view when in a closed or substantially closed position.

27. The portfolio assembly of claim 21 wherein said spine portion is generally flat and planar, and extends generally inwardly away from one of said hinge lines.

28. The portfolio assembly of claim 21 including a binding mechanism located on said spine portion.

29. The portfolio assembly of claim 28 wherein said binding mechanism is located between a pair of panels of one of said portfolios.

30. The portfolio assembly of claim 21 wherein said first portfolio is formed from a single unitary piece of sheet-like material, and wherein said second portfolio is formed from a single unitary piece of sheet-like material, and wherein one of said portfolios is nested inside the other one of said portfolios.

31. The portfolio assembly of claim 21 wherein each panel is a generally flat, sheet-like piece of material having two opposed major flat free surfaces defining the majority of the surface area of the associated panel.

32. A portfolio assembly comprising:

a first portfolio including a pair of opposed panels with a hinge line extending therebetween;

a second portfolio including a pair of opposed panels with a hinge line extending therebetween, wherein said first and second portfolios are directly coupled together and at least one of said portfolios includes a binding mechanism for binding loose leaf papers to said portfolio assembly, wherein at least one of said panels of at least one of said portfolios is movable relative to the other panel of said at least one portfolio by pivoting said at least one panel about an associated hinge line; and a spine portion extending generally parallel to said panels when said portfolio assembly is in a closed position wherein said panels of each portfolio are facing each other and are generally parallel.

33. The portfolio of claim 32 wherein said first and second portfolios are coupled together at or adjacent to said hinge lines.

34. The portfolio of claim 33 wherein said binding mechanism is located at or adjacent to the associated hinge line.

35. The portfolio assembly of claim 32 wherein both of said panels of said at least one of said portfolios are movable relative to each other by pivoting either of said panels about the associated hinge line.

36. The portfolio assembly of claim 32 wherein both of said panels of both said portfolios are movable relative to the other panel of the associated portfolio by pivoting either of said panels about the associated hinge line.

37. The portfolio assembly of claim 32 wherein each panel of each portfolio is a generally flat, planar sheet-like material joined to the other panel of the associated portfolio at or immediately adjacent to the associated said hinge line to form a portfolio that is generally "V" shaped in end view.

38. The portfolio assembly of claim 32 wherein said binding mechanism is located on said spine portion.

39. The portfolio assembly of claim 38 wherein said binding mechanism is located between a pair of panels of one of said portfolios.

40. The portfolio assembly of claim 32 wherein said first portfolio is formed from a single unitary piece of sheet-like material, and wherein said second portfolio is formed from a single unitary piece of sheet-like material, and wherein one of said portfolios is nested inside the other one of said portfolios.

41. The portfolio assembly of claim 32 wherein each panel is a generally flat, sheet-like piece of material having two opposed major flat free surfaces defining the majority of the surface area of the associated panel.

42. A portfolio assembly comprising:

a first panel of generally flat, sheet-like material having a pocket located thereon;

a second panel of generally flat, sheet-like material having a pocket located thereon;

a third panel of generally flat, sheet-like material having a pocket located thereon; and a fourth panel of generally flat, sheet-like material having a pocket located thereon, wherein each panel is joined together at or immediately adjacent to a common hinge portion, wherein said first panel is opposed said second panel relative to said hinge line and said third panel is opposed said fourth panel relative to said hinge line, and wherein said third panel is located on top of said first panel and said fourth panel is located on top of said second panel such that the pocket of said first panel is located adjacent to a rear surface of said third panel and the pocket of said second panel is located adjacent to a rear surface of said fourth panel wherein said portfolio assembly further includes a spine portion extending generally parallel to said panels when said portfolio assembly is in a closed position wherein said panels are facing each other and are generally parallel.

43. The portfolio assembly of claim 42 wherein each of said panels are movable relative to each other by pivoting said panels about said hinge portion.

44. The portfolio assembly of claim 42 wherein each panel is a generally flat, planar panel that is joined to the other panels at or immediately adjacent to the hinge portion to form a portfolio assembly that is generally "V" shaped in end view when in a closed or substantially closed position.

45. The portfolio assembly of claim 42 wherein said spine portion is generally flat and planar, and extends generally inwardly away from said hinge portion.

46. The portfolio assembly of claim 42 further including a binding mechanism located on said spine portion.

47. The portfolio assembly of claim 46 wherein said binding mechanism is located between a pair of panels.

48. The portfolio assembly of claim 42 wherein each panel is a generally flat, sheet-like piece of material having two opposed major flat free surfaces defining the majority of the surface area of the associated panel.

* * * * *